US006509886B2

(12) United States Patent
Ohno

(10) Patent No.: US 6,509,886 B2
(45) Date of Patent: Jan. 21, 2003

(54) TWO-DIMENSIONAL LIGHT-EMITTING ELEMENT ARRAY DEVICE AND METHOD FOR DRIVING THE SAME

(75) Inventor: Seiji Ohno, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/826,821

(22) Filed: Apr. 4, 2001

(65) Prior Publication Data

US 2001/0010510 A1 Aug. 2, 2001

Related U.S. Application Data

(62) Division of application No. 09/287,686, filed on Apr. 7, 1999, now Pat. No. 6,266,036.

(30) Foreign Application Priority Data

Apr. 10, 1998 (JP) ..... 10-98774

(51) Int. Cl.[7] ..... G09G 3/32
(52) U.S. Cl. ..... 345/82; 345/39; 345/46
(58) Field of Search ..... 345/39, 45, 46, 345/82

(56) References Cited

U.S. PATENT DOCUMENTS

| | | | | |
|---|---|---|---|---|
| 5,177,405 A | | 1/1993 | Kusuda et al. | |
| 5,451,977 A | | 9/1995 | Kusuda et al. | |
| 5,814,841 A | | 9/1998 | Kusuda et al. | |
| 6,002,420 A | | 12/1999 | Tanioka et al. | |
| 6,025,858 A | | 2/2000 | Tanioka et al. | |
| 6,069,644 A | | 5/2000 | Tanioka et al. | |
| 6,108,018 A | * | 8/2000 | Narita et al. | 345/82 |
| 6,184,971 B1 | | 2/2001 | Narita et al. | |
| 6,229,508 B1 | * | 5/2001 | Kana | 345/82 |
| 6,266,036 B1 | * | 7/2001 | Ohno | 345/82 |
| 6,392,617 B1 | * | 5/2002 | Gleason | 345/82 |
| 6,396,466 B1 | * | 5/2002 | Pross et al. | 345/82 |

FOREIGN PATENT DOCUMENTS

| | | |
|---|---|---|
| DE | 2516959 | 11/1975 |
| EP | 0410695 | 1/1991 |

* cited by examiner

*Primary Examiner*—Richard Hjerpe
*Assistant Examiner*—Kimnhung Nguyen
(74) *Attorney, Agent, or Firm*—RatnerPrestia

(57) ABSTRACT

A dimensional light-emitting element array device is provided. The device comprises a light-emitting element array in which a plurality of three-terminal light-emitting thyristors are arranged in X-Y matrix of N rows×M columns; a plurality of row lines to each thereof an anode of the thyristor on a corresponding row of the matrix is connected; one clock line to which all the row lines are connected; a plurality of row address lines to each thereof a gate of the thyristor on a corresponding row and a 0th column of the matrix is connected; and a plurality of column address lines to each thereof a gate of the thyristor on a corresponding column of 1st–Mth columns of the matrix is connected.

4 Claims, 7 Drawing Sheets

TWO-DIMENSIONAL LIGHT-EMITTING ELEMENT ARRAY DEVICE AND METHOD FOR DRIVING THE SAME

This application is a Divisional Application, claiming the benefit of U.S. patent application Ser. No. 09/287,686, filed Apr. 7, 1999, now U.S. Pat. No. 6,266,036.

BACKGROUND OF THE INVENTION

1. Field of the Invention

The present invention generally relates to a two-dimensional light-emitting element array device, particularly to a two-dimensional light-emitting element array device using three-terminal light-emitting thyristors. The present invention further relates to a method for driving such a two-dimensional light-emitting element array device.

2. Description of the Prior Art

A two-dimensional light-emitting element array device constituted by arranging a plurality of three-terminal thyristors of PNPN structure in two-dimension have been disclosed in Japanese Patent Publication Nos. 3-200364 and 3-273288, these publications being related to the Japanese Patent applications filed by the present applicant.

The two-dimensional light-emitting array device disclosed in these publications, however, needs at least three light-emitting thyristors and three clock lines for constituting one picture-element, so that there is such a problem that the area of one picture-element is large.

FIG. 1 shows the two-dimensional light-emitting element array device disclosed in Japanese Patent Publication No. 3-273288. In this device, a plurality of light-emitting thyristors are arranged in two-dimension, i.e., in X-Y matrix. Clock lines $CK_1$–$CK_3$ which supply clocks $\phi_1$–$\phi_3$ respectively are connected to the thyristor in such a way that each clock line is connected obliquely from the thyristor on upper left to the thyristor on lower right.

In this two-dimensional light-emitting element array device, ON state (light-on state) of the light-emitting thyristor P may be transferred on the device toward the right side or lower side on the drawing. In this case, four light-emitting thyristors enclosed by a dotted-line 10 constitutes one picture-element. Therefore, the area of one picture-element is large, resulting in the low density of picture-elements.

SUMMARY OF THE INVENTION

The object of the present invention is to provide a two-dimensional light-emitting element array device in which the density of picture-elements may be increased.

Another object of the present invention is to provide a method for driving the two-dimensional light emitting element array device.

According to a first aspect of the present invention, a two-dimensional light-emitting element array device comprises a light-emitting element array in which a plurality of three-terminal light-emitting thyristors are arranged in X-Y matrix of N rows×M columns ($N \geqq 1$, $M \geqq 0$) ; a plurality of row lines to each thereof an anode of the thyristor on a corresponding row of the matrix is connected; one clock line to which all the row lines are connected; a plurality of row address lines to each thereof a gate of the thyristor on a corresponding row and a 0th column of the matrix is connected; and a plurality of column address lines to each thereof a gate of the thyristor on a corresponding column of 1st-Mth columns of the matrix is connected; and light-emitting portions of all the thyristors on the 0th column are covered by an opaque material.

A method for driving this device in such a manner that one or more thyristors on a Jth column ($1 \leqq J \leqq M$) of the matrix is intended to emit light comprises the steps of: driving a row address line to High-level, which is of a corresponding row of the matrix on which a thyristor to be emitted light is, while driving other row address lines to Low-level; driving a column address line on the Jth column to Low-level, while driving other column address lines to High-level; and driving the clock line to High-level.

According to a second aspect of the present invention, a two-dimensional light-emitting element array device comprises a light-emitting element array in which a plurality of three-terminal light-emitting thyristors are arranged in X-Y matrix of N rows×M columns ($N \geqq 1$, $M \geqq 1$); one clock line to which anodes of all the thyristors are connected; a plurality of row address lines to each thereof a gate of the thyristor on a corresponding row of the matrix is connected through a first resistor; and a plurality of column address lines to each thereof a gate of the thyristor on a corresponding column of the matrix is connected through a second resistor.

A method for driving this device in such a manner that a thyristor on a Ith row and Jth column ($1 \leqq I \leqq N$, $1 \leqq J \leqq M$) of the matrix is intended to emit light comprises the steps of: driving a row address line on the Ith row to Low-level, while driving other row address lines to High-level; driving a column address line of the Jth column to Low-level, while driving other column address lines to High-level; and driving the clock line to High-level.

According to a third aspect of the present invention, a two-dimensional light-emitting element array device comprises a light-emitting element array in which a plurality of three-terminal light-emitting thyristors are arranged in X-Y matrix of N rows×M columns ($N \geqq 1$, $M \geqq 0$); a plurality of row lines to each thereof an anode of the thyristor on a corresponding row of the matrix is connected; one clock line to which all the row lines are connected; a plurality of row address lines to each thereof a gate of the thyristor on a corresponding row and a 0th column of the matrix is connected; a plurality of column address lines to each thereof a gate of the thyristor on a corresponding column of 1st–Mth columns of the matrix is connected; a first self-scanning type transfer element array for driving the column address lines to High-level or Low-level by self scanning thereof; and a second self-scanning type transfer element array for driving the row address lines to High-level or Low-level by self scanning thereof; and light-emitting portions of all the thyristors on the 0th column are covered by an opaque material.

A method for driving this device in such a manner that one or more thyristors on a Jth column ($1 \leqq J \leqq M$) of the matrix is intended to emit light comprises the steps of: driving the column address lines in turn to High-level by the first self-scanning type transfer element array; driving one or more row address lines to High-level, while driving other row address lines to Low-level by the second self-scanning type transfer element array, when the column address line on the Jth column is driven to Low-level; and driving the clock line to High-level.

According to a fourth aspect of the present invention, a two-dimensional light-emitting element array device comprises a light-emitting element array in which a plurality of three-terminal light-emitting thyristors are arranged in X-Y matrix of N rows×M columns ($N \geqq 1$, $M \geqq 1$); one clock line to which anodes of all the thyristors are connected; a plurality of row address lines to each thereof a gate of the thyristor on a corresponding row of the matrix is connected through a first resistor; a plurality of column address lines to each thereof a gate of the thyristor on a corresponding column of the matrix is connected through a second resistor; a first-scanning type transfer element array for driving the column address lines to High-level or Low-level by self scanning thereof; and a second-scanning type transfer element array for driving the row address lines to High-level or Low-level by self scanning thereof.

A method for driving this device in such a manner that a thyristor on a Ith row and Jth column ($1 \leqq I \leqq N$, $1 \leqq J \leqq M$) of the matrix is intended to emit light comprises the steps of: driving the column address lines in turn to Low-level by the first self-scanning type transfer element array; driving the row address lines in turn to Low-level by the second self-scanning type transfer element array, when the column address line on the Jth column is driven to Low-level; and driving the clock line to High-level.

According to the present invention, the density of picture-elements of the device may be increased, since one light-emitting thyristor constitutes one picture-element.

BRIEF DESCRIPTION OF THE DRAWINGS

The foregoing and other objects, aspects and advantages will be better understood from the following detailed description of preferred embodiments of the invention with reference to the drawings.

DESCRIPTION OF THE EXEMPLARY EMBODIMENT

The explanation of a three-terminal light-emitting thyristor will be given in briefly, before various preferred embodiments are described. Generally, LED (Light-Emitting Diode) and LD (Laser Diode) are known as a representative of light-emitting elements. LED constitutes a PN or PIN junction by compound semiconductor such as GaAs, GaP, GaAlAs, and the like, and utilizes a light-emitting phenomenon based on the recombination of carriers injected into the junction to which a forward voltage is applied.

LD has a structure in which a waveguide is provided in LED. When a current larger than a threshold current flows into LD, electron-hole pairs are increased to arise population inversion. Thus, the multiplication of photon due to a stimulated emission is occurred to generate light by means of parallel reflecting mirrors formed by cleavage planes. The light is again fed back to an active layer to cause a laser oscillation, and a laser is emitted from the end surface of the wave guide.

Also, a negative-resistance element (a light-emitting thyristor, a laser thyristor, and the like) is known which has same light-emitting mechanism as that of LED and LD. The light-emitting thyristor constitutes a PNPN structure with compound semiconductor, and is commercially available as a silicon thyristor.

Figure 1:
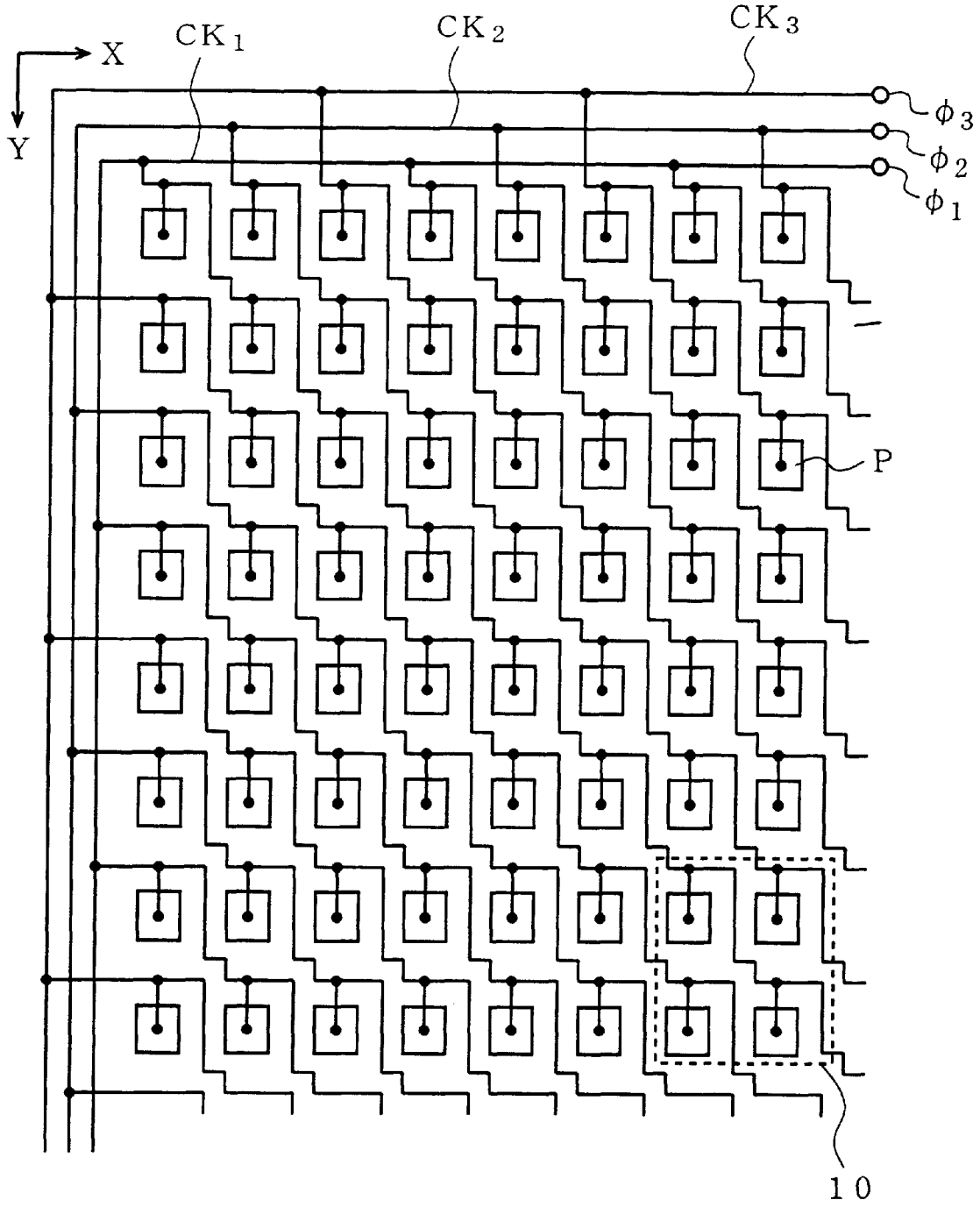
FIG. 1 shows a conventional two-dimensional light-emitting element array device.
Figure 2:
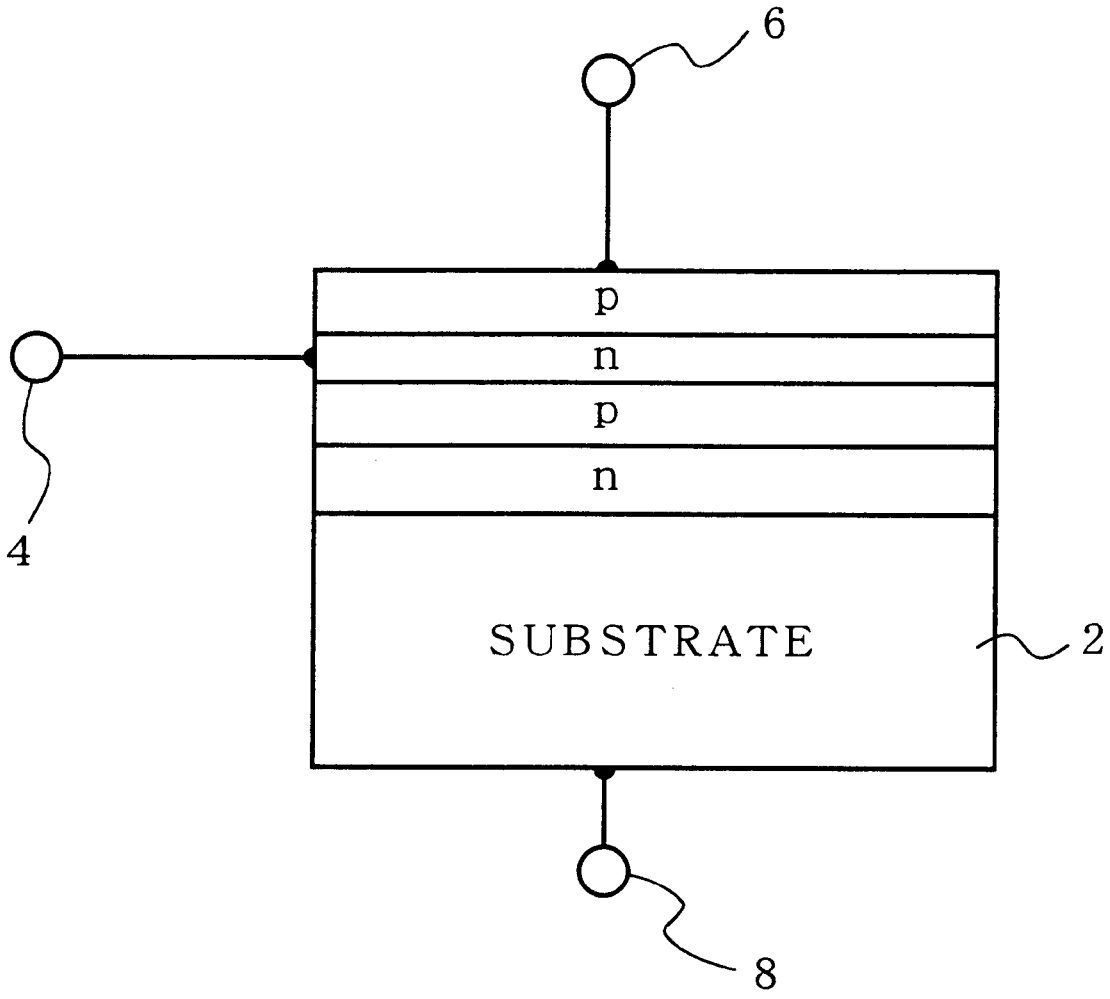
FIG. 2 shows a fundamental structure of a three-terminal light-emitting thyristor.

FIG. 2 shows a fundamental structure of a three-terminal light-emitting thyristor. As shown in the figure, a PNPN structure is formed on an N-type GaAs substrate 2. The thyristor has three terminals, i.e., a gate 4, an anode 6, and a cathode 8. The gate 4 serves for controlling an ON voltage, i.e., a turn-on voltage applied to the anode 6. The ON voltage is equal to the voltage, i.e., the sum of a diffusion potential of the PN junction and a voltage drop due to a current necessary for turning-on the thyristor. When the thyristor is turned-on, the voltage of the gate 4 becomes substantially equal to the voltage of the cathode 8. Therefore, if the cathode 8 is connected to the ground, then the gate voltage becomes 0 volt.

Figure 3:
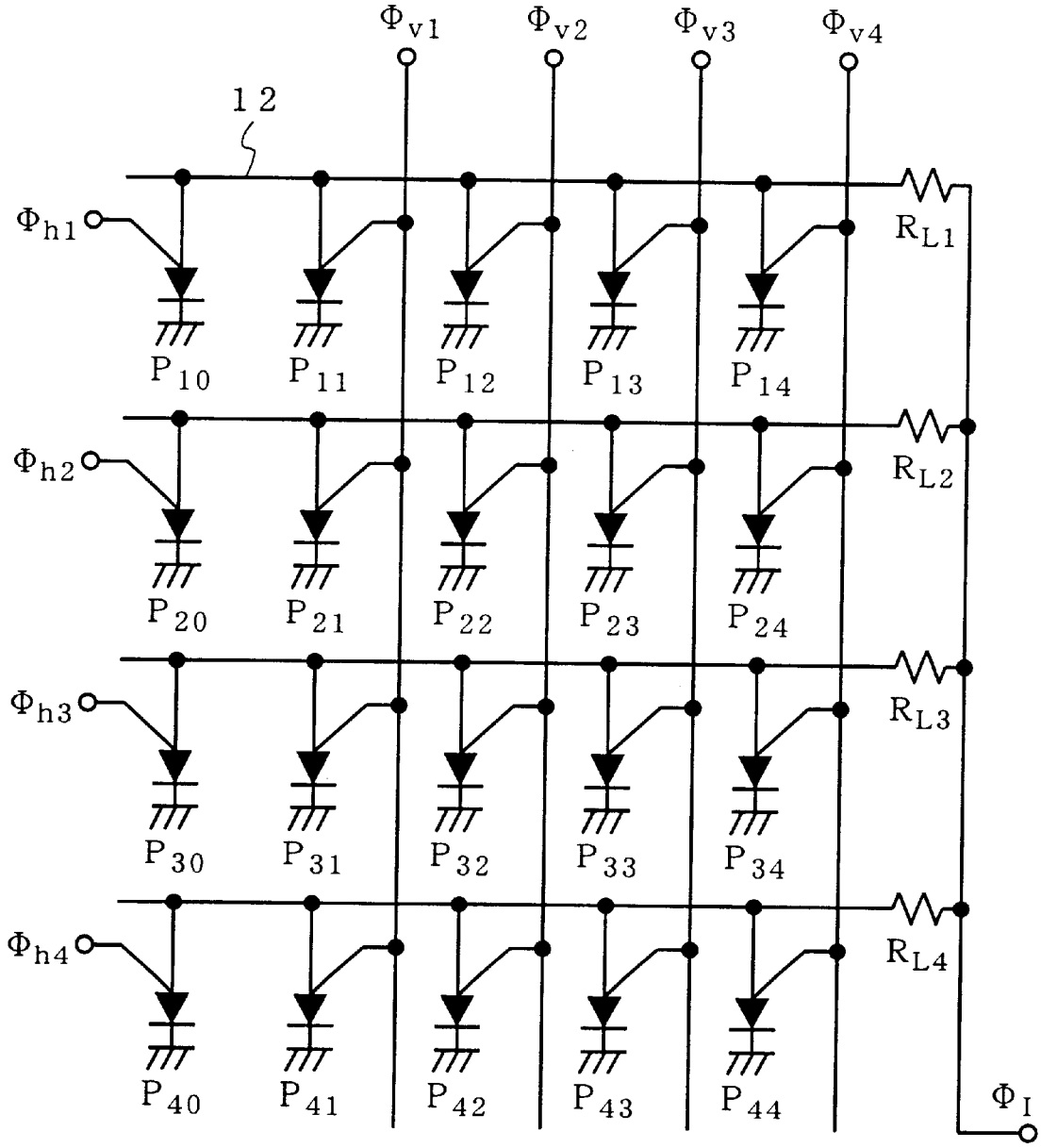
FIG. 3 shows a first embodiment of the two-dimensional light-emitting element array device of the present invention.

FIG. 3 shows a first embodiment of the two-dimensional light-emitting element array device according to the present invention. This device comprises a light-emitting element array in which a plurality of three-terminal light-emitting thyristors are arranged in two-dimension, i.e., in an X-Y matrix of N rows×M columns ($N \geqq 1$, $M \geqq 0$). In the figure, the matrix of 4×5 is shown for simplicity of the drawing.

In this device, the anodes of the thyristors on the Ith row ($1 \leqq I \leqq N$) of the matrix are connected to a corresponding row line 12 of the Ith row. Each row line 12 is connected to a clock line $\Phi_1$ through a corresponding resistor $R_{L1}$, $R_{L2}$, $R_{L3}$, . . . as shown in the figure. The gates of the thyristors on the Jth column ($1 \leqq J \leqq M$) of the matrix are connected to a corresponding column address line $\Phi_{v1}$, $\Phi_{v2}$, $\Phi_{v3}$, . . . , respectively. On the other hand, the gates of the thyristors $P_{10}$, $P_{20}$, $P_{30}$, . . . on the 0th column are connected to a corresponding row address lines $\Phi_{h1}$, $\Phi_2$, $\Phi_3$, . . . , respectively. The cathodes of all the thyristors are connected to the ground. Light-emitting portions of all the thyristors $P_{10}$, $P_{20}$, $P_{30}$, . . . on the 0th column are covered by an opaque material (not shown) in order to prevent the emitted light from leaking to the surface of the device.

For the thyristors connected to the same row line 12, when the clock line $\Phi_I$ is driven to High-level, the thyristor having the lowest gate voltage may emit light at the beginning. When the thyristor is turned-on, the gate voltage thereof goes to the voltage of the cathode, i.e., 0 volt, and the anode voltage thereof substantially equals to a diffusion voltage of the PN junction. As a result, the voltage of the row line 12 is fixed to said anode voltage. Therefore, other thyristors connected to the same row line 12 may not turn-on even if the gate voltage thereof goes to Low-level i.e., 0 volt. That is, if the Ith row address line $\Phi_{hI}$ is at Low-level, the thyristor $P_{I0}$ on the 0th column will preferentially emit light when the clock line $\Phi_I$ is driven to High-level. On the other hand, if the Ith row address line $\Phi_{hI}$ is at High-level, the thyristor will emit light to which the Jth column address line $\Phi_{vJ}$ driven to Low-level is connected.

Next, a method for driving the two-dimensional light-emitting element array device shown in FIG. 3 will be explained. It is assumed that any thyristor on the Jth column of the matrix is caused to emit light. First, the 1st–Nth row address lines are driven to High-level or Low-level, respectively, according to light-emission information. Then, the Jth column address line $\Phi_{vJ}$ selected by scanning is driven to Low-level, and the column address lines other than the column address line $\Phi_{vJ}$ are driven to High-level. Then, the clock line $\Phi_I$ is driven to High-level. At this time, in the case of the Ith row address line driven to High-level, the thyristor $P_{IJ}$ on the Ith row and Jth column of the matrix emits light, and in the case of the Ith row address line driven to Low-level, the thyristor $P_{I0}$ covered by the opaque material on the Ith row and 0th column emits light. After the clock line $\Phi_I$ is driven to Low-level in order to stop the light-emission of the thyristor on the Jth column, at least one thyristors on next (J+1) column is caused to emit light.

Figure 4:
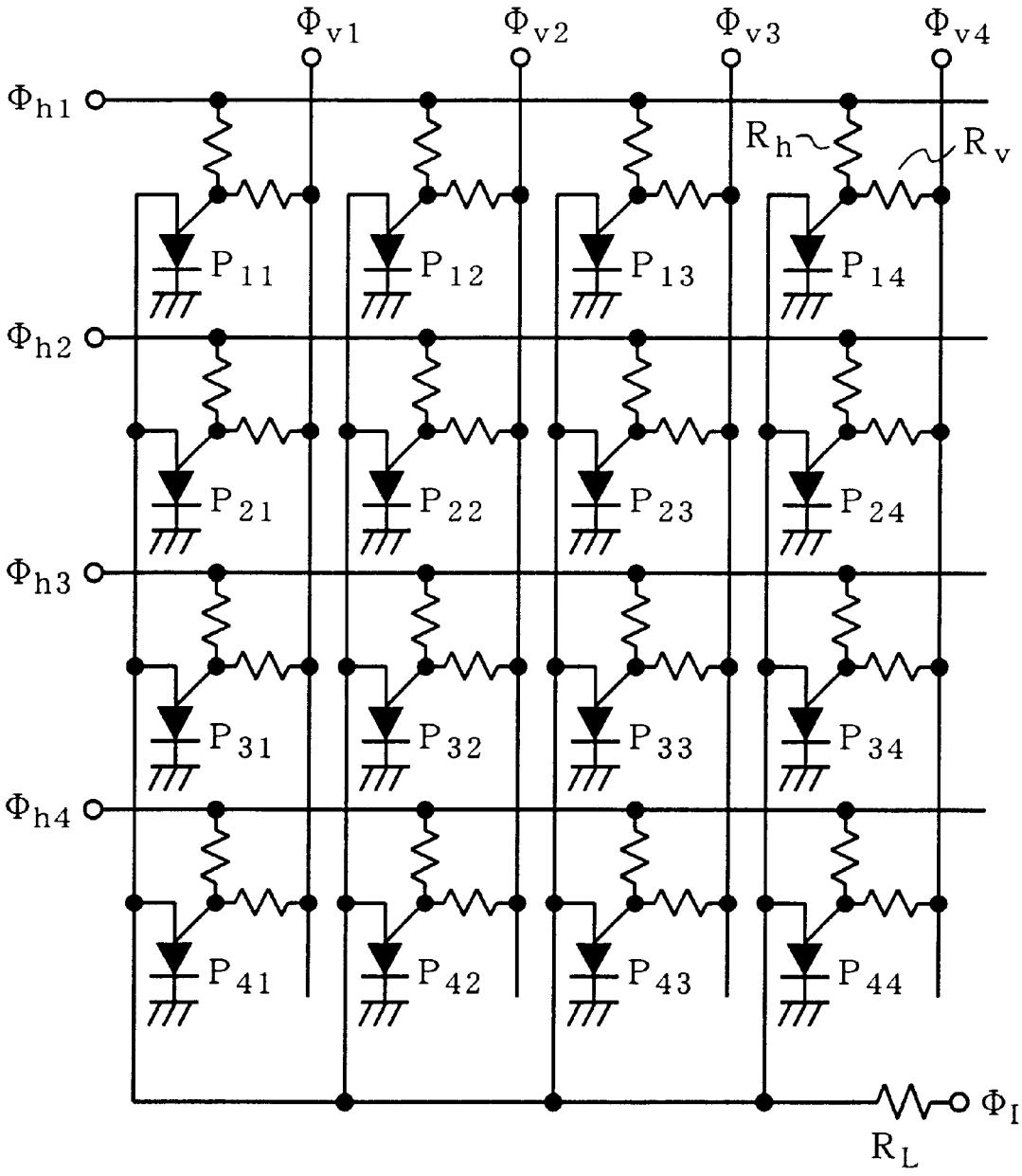
FIG. 4 shows a second embodiment of the two-dimensional light-emitting element array device of the present invention.

FIG. 4 shows a second embodiment of the two-dimensional light-emitting element array device according to the present invention. This device comprises a light-emitting element array in which a plurality of three-terminal light-emitting thyristor are arranged in an X-Y matrix of N rows×M columns ($N \geqq 1$, $M \geqq 1$). In the figure, the matrix of 4×4 is shown for simplicity of the drawing. In this device, anodes of all the thyristors are connected together to a clock line $\Phi_I$ through a resistor $R_L$. The gate of the thyristor $P_{IJ}$ on the Ith row and Jth column ($1 \leqq I \leqq N$, $1 \leqq J \leqq M$) of the matrix is connected to a row address line $\Phi_{hI}$ of the Ith row through a resistor $R_h$, and to a column address line $\Phi_{vJ}$ of the Jth column through a resistor $R_v$.

The gate voltage of the thyristor $P_{IJ}$ is equal to the mean value of both the voltage of the Ith row address line $\Phi_{hI}$ and the voltage of the Jth column address line $\Phi_{hJ}$, if the values of two resistors $R_h$, $R_v$ are selected to be equal. Therefore, when both the Ith row address line $\Phi_{hI}$ and the Jth column address line $\Phi_{vJ}$ are driven to Low-level and other row address lines and column address lines are driven to High-level, the gate voltage of the thyristor $P_{IJ}$ goes to the lowest voltage such as 0 volt. Therefore, when the clock line $\Phi_I$ is driven to High-level, the thyristor $P_{IJ}$ emits light and other thyristors do not emit light. In this manner, only one thyristor may emit light among the thyristors arranged in the X-Y matrix at the same time.

Figure 5:
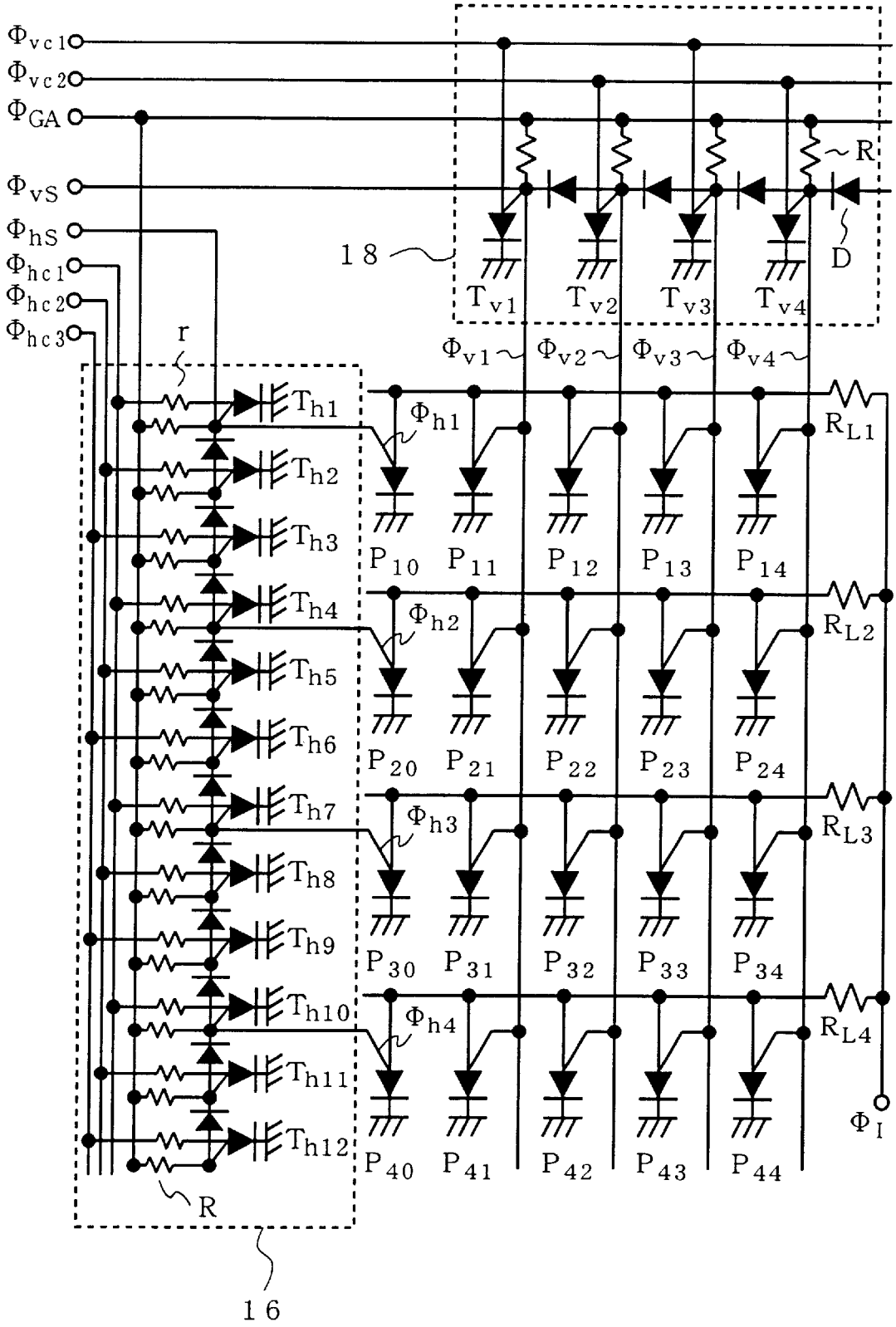
FIG. 5 shows a third embodiment of the two-dimensional light-emitting element array device of the present invention.

FIG. 5 shows a third embodiment of the two-dimensional light-emitting element array device according to the present invention. This device comprises a light-emitting element array of N×M matrix which is same as the array shown in FIG. 3., a three-phase driving self-scanning type transfer element array 16 for driving the row address lines $\Phi_{h1}$, $\Phi_{h2}$, $\Phi_{h3}$, . . . of the light-emitting element array, and a two-phase driving self-scanning type transfer element array 18 for driving the column address lines $\Phi_{v1}$, $\Phi_{v2}$, $\Phi_{v3}$, . . . of the light-emitting element array. These self-scanning type transfer element array 16 and 18 are the same type of array as disclosed in Japanese Patent No. 2577034 issued to the present applicant, the content of this Japanese patent being incorporated herein by reference.

In the three-phase driving self-scanning type transfer element array 16, a plurality of transfer elements connected to the same transfer clock line may be turned-on at the same time. On the other hand, in the two-phase driving self-scanning type transfer element array 18, only one transfer element connected to the same transfer clock line may be turned-on at the same time.

The structure of the two-phase driving self-scanning type transfer element array 18 will now be explained. Transfer elements $T_{v1}$, $T_{v2}$, $T_{v3}$, . . . each thereof consisting of a three-terminal light-emitting thyristor are arranged in one dimension, i.e., in X-direction. The gates of adjacent transfer elements are interconnected through a diode D. Each gate of the transfer element is connected to a supply voltage $\Phi_{GA}$ through a corresponding load resistor R. The gate of the first transfer element $T_{v1}$ is connected to a start pulse line $\Phi_{vS}$. Respective anodes of the transfer elements are alternately connected to two-phase transfer clock lines $\Phi_{vc1}$, $\Phi_{vc2}$. Respective cathodes of the transfer elements are connected to the ground. Since the transfer elements consist of light-emitting thyristors, light-emitting portion thereof must be covered by an opaque material so that light does not come through to the surface of the device. Each gate of transfer elements in the array 18 is also connected to a corresponding column address line of the Jth column ($1 \leqq J \leqq M$) of the light-emitting element array.

When the transfer clock line $\Phi_{vc1}$ is driven to High-level, and thus the transfer element $T_{vJ}$ on the Jth column is turned-on, the gate voltage of this transfer element is reduced from the supply voltage $\Phi_{GA}$, e.g., 5 volts to about 0 volt. The voltage reducing effect works to the gate of the adjacent transfer element $T_{v(J+1)}$ on the right, setting the voltage of that gate to about 1 volt, i.e., a forward rise voltage of the thyristor. On the contrary, the voltage reducing effect does not work to the gate of the adjacent transfer element $T_{v(J-1)}$ on the left, because the diode D is reverse-biased.

The turn-on voltage of the transfer elements is approximated to the gate voltage plus the diffusion potential of the PN junction (about 1 volt). Therefore, if the voltage of the transfer clock line $\Phi_{vc2}$ is set to the voltage which is higher than about 2 volts which is necessary voltage for turning-on the transfer element $T_{v(J+1)}$ and lower than about 4 volts which is necessary voltage for turning-on the transfer element $T_{v(J+3)}$, only the transfer element $T_{v(J+1)}$ may be turned-on while keeping other transfer elements turned-off. Thus, ON state may be transferred by setting alternately the voltages of the two transfer clock lines $\Phi_{vc1}$ and $\Phi_{vc2}$ to High-level.

The structure of the three-phase driving self-scanning type transfer element array 16 is essentially the same as that of the two-phase driving self-scanning type transfer element array 18, except that the transfer clock lines are three-phase, i.e., $\Phi_{hc1}$. $\Phi_{hc2}$ and $\Phi_{hc3}$, and a current-limiting resistor r is inserted between an anode of each transfer element and the corresponding transfer clock line. As shown in FIG. 5, each anode of transfer elements $T_{h1}$, $T_{h2}$, $T_{h3}$, . . . is connected to each transfer clock line $\Phi_{hc1}$, $\Phi_{hc2}$ and $\Phi_{hc3}$ in a repeating manner, the gate of the first transfer element $T_{h1}$ is connected to a start clock line $\Phi_{hS}$, and the gates of all the transfer elements are connected to the common supply voltage $\Phi_{GA}$ through a corresponding load resistor R, respectively.

The transfer elements of the array 16 are constituted by light-emitting thyristors as in the case of the array 18, so that the light-emitting portions must be covered by a opaque material not so as to leak light.

The light-emitting thyristors $T_{h1}$, $T_{h4}$, $T_{h7}$, $Th_{10}$, . . . are connected to the corresponding row address line $\Phi_{h1}$, $\Phi_{h2}$, $\Phi_{h3}$, $\Phi_{h4}$ . . . , respectively.

As stated hereinbefore, the self-scanning type transfer element array 16 operate in such a manner that a plurality of light-emitting thyristors connected to the same transfer clock line may be turned-on at the same time. When the transfer clock line $\Phi_{hc1}$ connected to the transfer element $T_{h1}$ is at High-level, if the start clock line $\Phi_{hs}$ is at Low-level, then the transfer element $T_{h1}$ is turned-on, and if $\Phi_{hs}$ is at High-level, then $T_{h1}$ is not turned-on. When the transfer clock line $\Phi_{hc2}$, $\Phi_{hc3}$, $\Phi_{hc1}$ are driven to High-level in this sequence, ON/OFF state is transferred to the transfer element $T_{h4}$. At this time, depending on Low-level/High-level state of the start clock line $\Phi_{hs}$, ON/OFF state of the transfer element $T_{h1}$ is determined. Thus, Low-level/High-level information which is inputted to the start clock line $\Phi_{hs}$ is developed on the self-scanning type transfer element array 16 as ON/OFF states of the transfer elements.

The operation of the present embodiment will now be described. First, the transfer element $T_{v1}$ of the array 18 is caused to be turned-on by setting the start clock line $\Phi_{vS}$ to Low-level and the transfer clock line $\Phi_{vc1}$ to High-level. Thereby, the first column address line $\Phi_{v1}$ of the first column goes to Low-level.

Next, the light-emission information (ON/OFF information) for the thyristors on the first column of the matrix is inputted to the self-scanning type transfer element array 16, i.e., Low-level/High-level information is added to the start clock line $\Phi_{hS}$.

Figure 6:
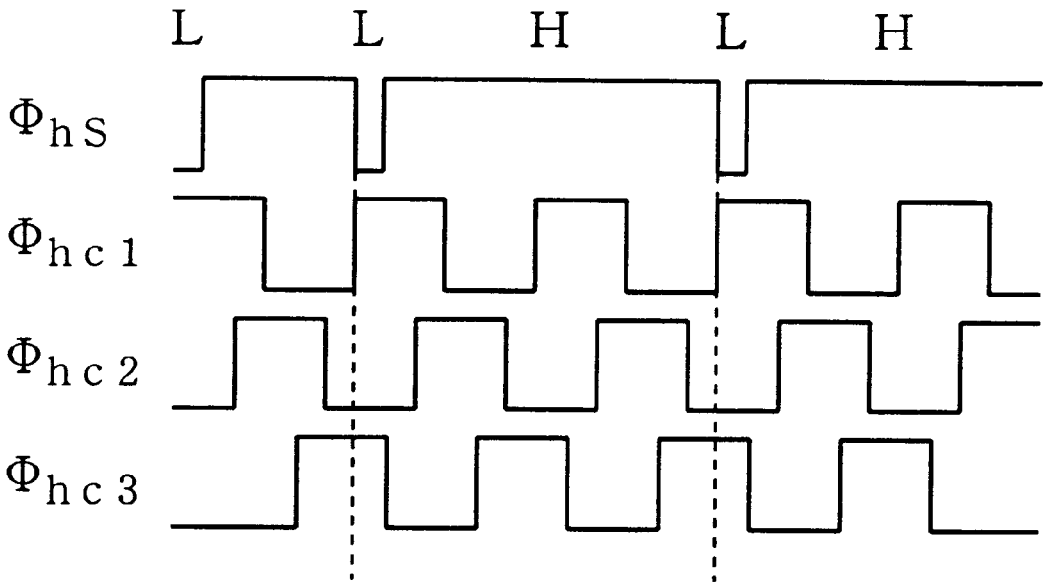
FIG. 6 shows exemplary driving pulses for a three-phase driving self-scanning type transfer element array.

FIG. 6 shows the timing of the start clock line $\Phi_{hS}$ and the transfer clock lines $\Phi_{hc1}$, $\Phi_{hc2}$, $\Phi_{hc3}$ in order that the light on/off state of the light-emitting elements $P_{11}$, $P_{21}$, $P_{31}$, $P_{41}$, and $P_{51}$ (not shown) on the first column are intended to be "on, off, on, off, off". For this light on/off state, the row address lines $\Phi_{h1}$, $\Phi_{h2}$, $\Phi_{h3}$, . . . must be High-, Low-, High-, Low-, Low-levels, respectively. Since the gate of the transfer element goes to Low-level when it is turned-on, the transfer elements $T_{h1}$, $T_{h4}$, $T_{h7}$, $T_{h10}$, and $T_{h13}$ (not shown) must be turned-off, -on, -off, -on, and -on, respectively. For this purpose, Low-level/High-level information added to the start clock line $\Phi_{hs}$ must be L, L, H, L, H (L and H mean Low-level and High-level, respectively) as shown in FIG. 6.

Thus, when the clock line $\Phi_I$ is driven to High-level after the light-emission information is inputted into the self-scanning transfer element array 16, the on, off, on, off, and off state of the light-emitting elements $P_{11}$, $P_{21}$, $P_{31}$, . . . is realized. When the clock line $\Phi_I$ is driven to Low-level, ON state is transferred to the adjacent transfer element $T_{v2}$ in the self-scanning type transfer element array 18. Next, the light-emission information for the second column of light-emitting elements is inputted into the array 16, and the clock line $\Phi_I$ is driven to High-level and then to Low-level, as a result, the on, off state of the light-emitting element $P_{12}$, $P_{22}$, $P_{32}$ . . . is realized. Such an operation as described above is repeated to cause the thyristors in the light-emitting element array to emit light.

While two-phase and three-phase self-scanning type transfer element array are used in the third embodiment, any transfer element array of two or more phases may be used.

Figure 7:
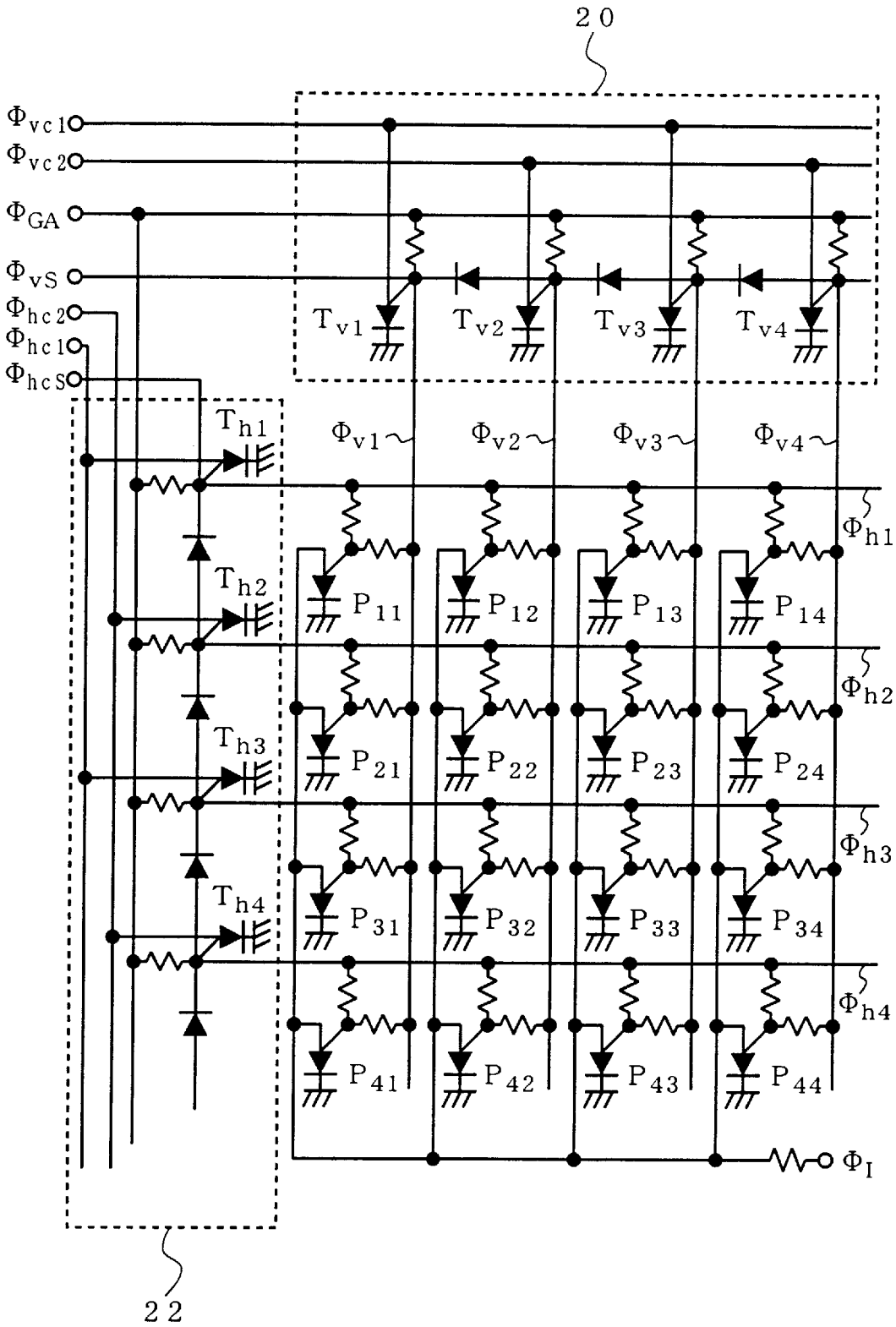
FIG. 7 shows a fourth embodiment of the two-dimensional light-emitting element array device of the present invention.

FIG. 7 shows the fourth embodiment of the two-dimensional light-emitting array device. This device comprises a light-emitting element array of N×M matrix which is the same as the array shown in FIG. 4., a two-phase driving self-scanning type transfer element array 20 for driving the column address lines Φv1, $\Phi_{v2}$, $\Phi_{v3}$, . . . of the light-emitting element array, and a two-phase driving self-scanning type transfer element array 22 for driving the row address lines $\Phi_{h1}$, $\Phi_{h2}$, $\Phi_{h3}$, . . . of the light-emitting element array. These self-scanning type transfer element array 20 and 22 are the same as the array 18 shown in FIG. 5. Since the operation of those two-phase transfer element arrays 20, 22 is the same as that of the array 18, the further explanation will be omitted.

In this embodiment, the self-scanning type transfer element array 20 is self-scanned so that the column address line $\Phi_{v1}$, $\Phi_{v2}$, $\Phi_{v3}$, . . . is driven to Low-level in turn. When one column address line is driven to Low-level, the self-scanning type transfer element array 22 is self-scanned so that the row address lines $\Phi_{h1}$, $\Phi_{h2}$, $\Phi_{h3}$, . . . a is driven to Low-level in turn. Then, the clock line $\Phi_I$ is driven to High-level at the timing when the thyristor is caused to emit light.

While the invention has been described in terms of preferred embodiments, those skilled in the art will recognize that the invention can be practiced with modification within the spirit and scope of the appended claims.

What is claimed is:

1. A two-dimensional light-emitting element array device, comprising:

a light-emitting element array in which a plurality of three-terminal light-emitting thyristors are arranged in X-Y matrix of N rows×M columns (N≧1, M≧1);

one clock line to which anodes of all the thyristors are connected;

a plurality of row address lines to each thereof a gate of the thyristor on a corresponding row of the matrix is connected through a first resistor; and a plurality of column address lines to each thereof a gate of the thyristor on a corresponding column of the matrix is connected through a second resistor.

2. A method for driving a two-dimensional light-emitting element array device of claim 1, wherein a thyristor on a Ith row and Jth column (1≦I≦N, 1≦J≦M) of the matrix is intended to emit light, comprising the steps of:

driving a row address line on the Ith row to Low-level, while driving other row address lines to High-level;

driving a column address line of the Jth column to Low-level, while driving other column address lines to High-level; and driving the clock line to High-level.

3. A two-dimensional light-emitting element array device, comprising:

a light-emitting element array in which a plurality of three-terminal light-emitting thyristors are arranged in X-Y matrix of N rows×M columns (N≧1, M≧1);

one clock line to which anodes of all the thyristors are connected;

a plurality of row address lines to each thereof a gate of the thyristor on a corresponding row of the matrix is connected through a first resistor;

a plurality of column address lines to each thereof a gate of the thyristor on a corresponding column of the matrix is connected through a second resistor;

a first-scanning type transfer element array for driving the column address lines to High-level or Low-level by self scanning thereof; and a second-scanning type transfer element array for driving the row address lines to High-level or Low-level by self scanning thereof.

4. A method for driving a two-dimensional light-emitting element array device of claim 3, wherein a thyristor on a Ith row and Jth column (1≦I≦N, 1≦J≦M) of the matrix is intended to emit light, comprising the steps of:

driving the column address lines in turn to Low-level by the first self-scanning type transfer element array;

driving the row address lines in turn to Low-level by the second self-scanning type transfer element array, when the column address line on the Jth column is driven to Low-level; and driving the clock line to High-level.

* * * * *

UNITED STATES PATENT AND TRADEMARK OFFICE

CERTIFICATE OF CORRECTION

PATENT NO. : 6,509,886 B2 
DATED : January 21, 2003
INVENTOR(S) : Seiji Ohno

It is certified that error appears in the above-identified patent and that said Letters Patent is hereby corrected as shown below:

Column 4,
Lines 37-38, "corresponding row address lines $\Phi_{h1}$, $\Phi_2$, $\Phi_3$,…, respec-tively." should read -- corresponding row address lines $\Phi_{h1}$, $\Phi_{h2}$, $\Phi_{h3}$,…, respec-tivley. --.

Column 6,
Line 38, "i.e., $\Phi_{hc1}$. $\Phi_{hc2}$ and $\Phi_{hc3}$, and a current-limiting resistor r is" should read -- i.e., $\Phi_{hc1}$, $\Phi_{hc2}$, and $\Phi_{hc3}$, and a current-limiting resistor r is --.

Column 7,
Line 49, "driving the column address lines $\Phi$v1, $\Phi_{v2}$, $\Phi_{v3}$,… of the" should read -- driving the column address lines $\Phi_{v1}$, $\Phi_{v2}$, $\Phi_{v3}$,… of the --.

Signed and Sealed this

Twenty-sixth Day of August, 2003

JAMES E. ROGAN
*Director of the United States Patent and Trademark Office*